US006757403B2

(12) United States Patent
Urushibata et al.

(10) Patent No.: US 6,757,403 B2
(45) Date of Patent: Jun. 29, 2004

(54) ELECTROACOUSTIC TRANSDUCERS

(75) Inventors: Kiyoshi Urushibata, Shizuoka (JP); Tomonari Suzuki, Shizuoka (JP)

(73) Assignee: Star Micronics Co., Ltd., Shizuoka (JP)

( * ) Notice: Subject to any disclaimer, the term of this patent is extended or adjusted under 35 U.S.C. 154(b) by 320 days.

(21) Appl. No.: 09/805,148

(22) Filed: Mar. 14, 2001

(65) Prior Publication Data

US 2001/0022844 A1 Sep. 20, 2001

(30) Foreign Application Priority Data

Mar. 16, 2000 (JP) ..... P2000-074496

(51) Int. Cl.[7] ..... H04R 25/00
(52) U.S. Cl. ..... 381/418; 381/412; 381/417
(58) Field of Search ..... 331/396, 400, 331/403, 407, 408, 409, 410, 412, 417, 418, 419, 420, 421

(56) References Cited

U.S. PATENT DOCUMENTS 3,819,876 A * 6/1974 Kinoshita ..... 381/407
4,443,667 A * 4/1984 Hunt ..... 381/407
5,602,931 A * 2/1997 Geisenberger ..... 381/400

FOREIGN PATENT DOCUMENTS

JP 58-99099 6/1983

* cited by examiner

*Primary Examiner*—Suhan Ni
(74) *Attorney, Agent, or Firm*—Morgan, Lewis & Bockius LLP

(57) ABSTRACT

A bobbin unit includes a base portion and a coil winding portion on which a conductor is wound. A hole is formed in a central part of the base portion to allow an armature to pass through. Coil side terminals to which ends of the conductor are fixed and signal input terminals to which an external signal is entered are provided at opposite ends of the base portion with the hole located in between. The coil side terminals are electrically connected to their corresponding signal input terminals inside the base portion. A coil is formed on the coil winding portion by winding the conductor. The ends of the conductor are fixed to the respective coil side terminals.

6 Claims, 17 Drawing Sheets

ELECTROACOUSTIC TRANSDUCERS

BACKGROUND OF THE INVENTION

1. Field of the Invention

The present invention relates to electroacoustic transducers used in hearing aids, for example.

2. Related Background Art

An known example of this kind of electroacoustic transducer is found in Japanese Unexamined Patent Publication No. 58-99099. An electroacoustic transducer disclosed in this Patent Publication comprises a case serving as a housing and a drive unit accommodated in the case. The drive unit includes a plate member, a coil, a pair of magnets and a yoke. The plate member includes a base plate portion, side plate portions extending parallel to each other from two opposite ends of the base plate portion, and an armature extending between the side plate portions from a central part of the base plate portion. The coil is bonded to inner surfaces of the side plate portions of the plate member. The two magnets are individually fixed to opposed inner surfaces of the yoke. Two opposite side surfaces of the yoke are fixed to extreme parts of the inner surfaces of the side plate portions of the plate member. With the plate member and the yoke fixed together, a terminal end of the armature is inserted in between the magnets such that the armature does not come into contact with the magnet pair. The drive unit is fixed to the case as the bottom surface of the yoke is fixed to the bottom of the case.

Both ends of the coil are passed through holes made in the case and connected to signal input terminals of a terminal strip which is fixed to a side wall of the case. In the electroacoustic transducer of the above-described type, conductor used for forming the coil is usually an extremely thin copper wire measuring about 25 $\mu$m in diameter.

The conventional electroacoustic transducer of the aforementioned construction has such disadvantages as (1) handling of end portions of the conductor is difficult since the conductor is extremely thin; and (2) the end portions of the conductor are liable to break when they are connected to the signal input terminals of the terminal strip because the terminal strip is fixed to the case. Thus, one of major problems of the conventional electroacoustic transducer is that it is impossible to easily connect the end portions of the conductor to the terminal strip.

Another problem of the conventional electroacoustic transducer is that lead wires from the coil to the signal input terminals of the terminal strip are liable to break due to vibrations or other external impact to the transducer, such as its dropping. This is because the distance between the coil and the terminal strip is long in the conventional electroacoustic transducer.

SUMMARY OF THE INVENTION

The present invention has been made in view of the aforementioned problems of the prior art. Accordingly, it is an object of the invention to provide an electroacoustic transducer which makes it possible to easily connect lead wire portions of a coil to signal input terminals and reduce the risk of lead wire breakage.

In one aspect of the invention, an electroacoustic transducer comprises a coil formed by winding a conductor and a bobbin unit on which the coil is formed, wherein the bobbin unit includes signal input terminals and coil side terminals to which the ends of the conductor are fixed, the coil side terminals being electrically connected to the signal input terminals, and wherein the signal input terminals and the coil side terminals are provided individually at different end portions of the bobbin unit.

Since the signal input terminals and the coil side terminals are provided on the bobbin unit in this electroacoustic transducer of the invention, the conductor is electrically connected to the signal input terminals when the ends of the conductor are fixed to the coil side terminals. This arrangement facilitates connection of the ends of the conductor constituting the coil to the signal input terminals. Furthermore, since the coil side terminals are provided on the bobbin unit and the coil is formed on the bobbin unit, it is possible to shorten the length of lead wire portions between the coil and the coil side terminals and thereby prevent breakage of the conductor between the coil and the coil side terminals.

Moreover, since the signal input terminals and the coil side terminals are provided at the different end portions of the bobbin unit in the electroacoustic transducer of the invention, the signal input terminals and the coil side terminals are separated from each other. Therefore, the distance from the tip of a welding electrode to each signal input terminal becomes larger than the distance from the tip of the electrode to the corresponding coil side terminal when the ends of the conductor are connected to the coil side terminals by arc welding, for instance. This helps prevent the occurrence of an arc between the tip of the electrode and the signal input terminals and produce an arc between the tip of the electrode and the coil side terminals in a reliable fashion. All these features of the invention ensure reliable connection of the ends of the conductor to the coil side terminals when fixing the ends of the conductor to the coil side terminals by arc welding.

In one preferred form of the invention, the electroacoustic transducer further comprises an armature unit having a base plate portion, at least one side plate portion extending from the base plate portion, and an armature extending from the base plate portion in the same direction as the side plate portion, the bobbin unit further including a base portion in which a hole for inserting the armature of the armature unit is made, a coil winding portion on which the conductor is wound, a magnet positioning portion for positioning a magnet, and a magnet retainer for retaining the magnet which is positioned in the magnet positioning portion, wherein the signal input terminals and the coil side terminals are provided at opposite positions with the hole in the base portion located in between. This construction makes it easy to arrange the signal input terminals and the coil side terminals on the base portion of the bobbin unit in which the hole for inserting the armature of the armature unit is made.

Furthermore, since the signal input terminals and the coil side terminals are provided on opposite positions with the hole in the base portion located in between, the signal input terminals and the coil side terminals are separated from each other. Therefore, the distance from the tip of a welding electrode to each signal input terminal becomes larger than the distance from the tip of the electrode to the corresponding coil side terminal when the ends of the conductor are connected to the coil side terminals by arc welding, for instance. This helps prevent the occurrence of an arc between the tip of the electrode and the signal input terminals and produce an arc between the tip of the electrode and the coil side terminals in a reliable fashion. All these features of the invention ensure reliable connection of the ends of the conductor to the coil side terminals when fixing the ends of the conductor to the coil side terminals by arc welding.

In another preferred form of the invention, the armature unit is fixed to the bobbin unit by fixing the side plate portion to the magnet retainer, and there is formed a clearance between the base portion in the bobbin unit and the base plate portion of the armature unit when the armature unit is fixed to the bobbin unit. This construction prevents direct contact between the side plate portion of the armature unit and the base portion of the bobbin unit and thereby prohibits the base portion of the bobbin unit from adversely affecting vibrations of the armature.

In still another preferred form of the invention, the base portion, the coil winding portion and the magnet positioning portion are one-piece molded using a resin material. This makes it possible to reduce the number of components and facilitate winding of the conductor on the bobbin unit and its assembly including fixing of the magnet.

In yet another preferred form of the invention, the electroacoustic transducer further comprises a housing in which the bobbin unit is accommodated, wherein an opening is formed in the housing at its location corresponding to the signal input terminals, and the signal input terminals project to the exterior of the housing through the opening when the bobbin unit is accommodated in the housing. With this arrangement, it becomes possible to provide a construction in which the signal input terminals are exposed to the exterior of the housing in a simple and inexpensive way.

In another aspect of the invention, an electroacoustic transducer comprises a coil formed by winding a conductor and a bobbin unit on which the coil is formed, wherein the bobbin unit includes signal input terminals and coil side terminals to which the ends of the conductor are fixed, the coil side terminals being electrically connected to the signal input terminals, wherein the ends of the conductor are fixed to the coil side terminals by arc welding, and wherein the signal input terminals and the coil side terminals are provided at positions where the distance from the tip of an electrode used for arc welding to the coil side terminals is smaller than the distance from the tip of the welding electrode to the signal input terminals.

Since the signal input terminals and the coil side terminals are provided on the bobbin unit in this electroacoustic transducer of the invention, the conductor is electrically connected to the signal input terminals when the ends of the conductor are fixed to the coil side terminals. This arrangement facilitates connection of the ends of the conductor constituting the coil to the signal input terminals. Furthermore, since the coil side terminals are provided on the bobbin unit and the coil is formed on the bobbin unit, it is possible to shorten the length of lead wire portions between the coil and the coil side terminals and thereby prevent breakage of the conductor between the coil and the coil side terminals.

In this electroacoustic transducer of the invention, the distance from the tip of the welding electrode to each signal input terminal becomes larger than the distance from the tip of the electrode to the corresponding coil side terminal in arc welding. This helps prevent the occurrence of an arc between the tip of the electrode and the signal input terminals and produce an arc between the tip of the electrode and the coil side terminals in a reliable fashion. All these features of the invention ensure reliable connection of the ends of the conductor to the coil side terminals by arc welding.

In one preferred form of the invention, the electroacoustic transducer further comprises a housing in which the bobbin unit is accommodated, wherein an opening is formed in the housing at its location corresponding to the signal input terminals, and the signal input terminals project to the exterior of the housing through the opening when the bobbin unit is accommodated in the housing. With this arrangement, it becomes possible to provide a construction in which the signal input terminals are exposed to the exterior of the housing in a simple and inexpensive way.

In still another aspect of the invention, an electroacoustic transducer comprises a coil formed by winding a conductor, a bobbin unit on which the coil is formed, and a housing in which the bobbin unit is accommodated, wherein the bobbin unit includes signal input terminals and coil side terminals to which the ends of the conductor are fixed, the coil side terminals being electrically connected to the signal input terminals, and wherein an opening is formed in the housing at its location corresponding to the signal input terminals, and the signal input terminals project to the exterior of the housing through the opening when the bobbin unit is accommodated in the housing.

Since the signal input terminals and the coil side terminals are provided on the bobbin unit in this electroacoustic transducer of the invention, the conductor is electrically connected to the signal input terminals when the ends of the conductor are fixed to the coil side terminals. This arrangement facilitates connection of the ends of the conductor constituting the coil to the signal input terminals. Furthermore, since the coil side terminals are provided on the bobbin unit and the coil is formed on the bobbin unit, it is possible to shorten the length of lead wire portions between the coil and the coil side terminals and thereby prevent breakage of the conductor between the coil and the coil side terminals.

Furthermore, since the signal input terminals project to the exterior of the housing through the opening when the bobbin unit is accommodated in the housing in this electroacoustic transducer of the invention, it is possible to provide a construction in which the signal input terminals are exposed to the exterior of the housing in a simple and inexpensive way.

The present invention will become more fully understood from the detailed description given hereinbelow and the accompanying drawings which are given by way of illustration only, and thus are not to be considered as limiting the present invention.

DESCRIPTION OF THE PREFERRED EMBODIMENT

Figure 1:
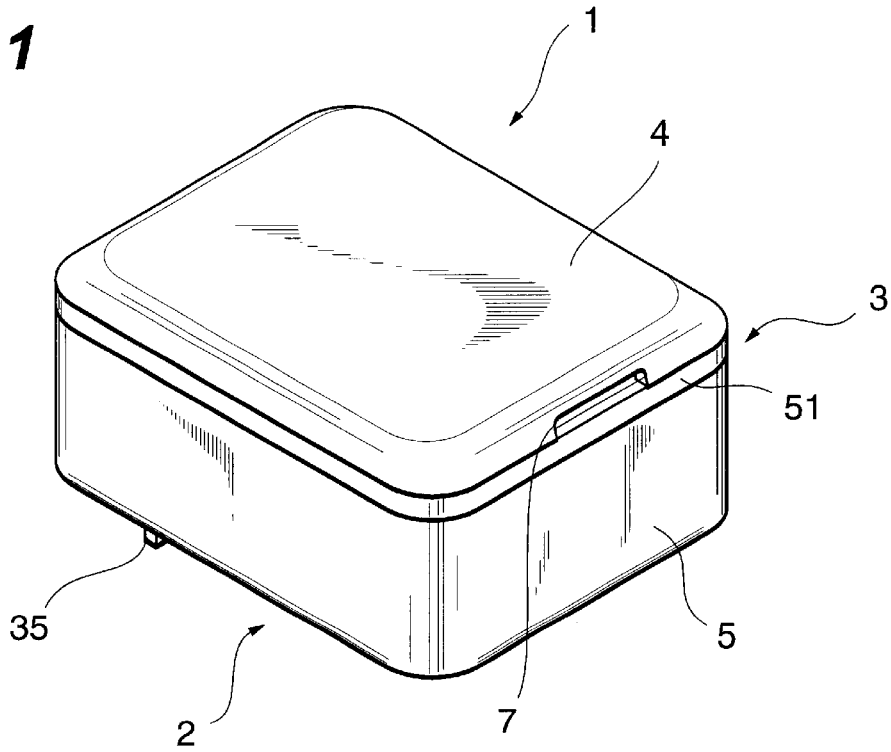
FIG. 1 is a perspective view showing the overall external appearance of an electroacoustic transducer according to an embodiment of the invention.

An electroacoustic transducer according to a preferred embodiment of the invention is now described in detail referring to the accompanying drawings, in which the same elements are designated by the same reference numerals and duplication of their explanation is avoided.

Figure 2:
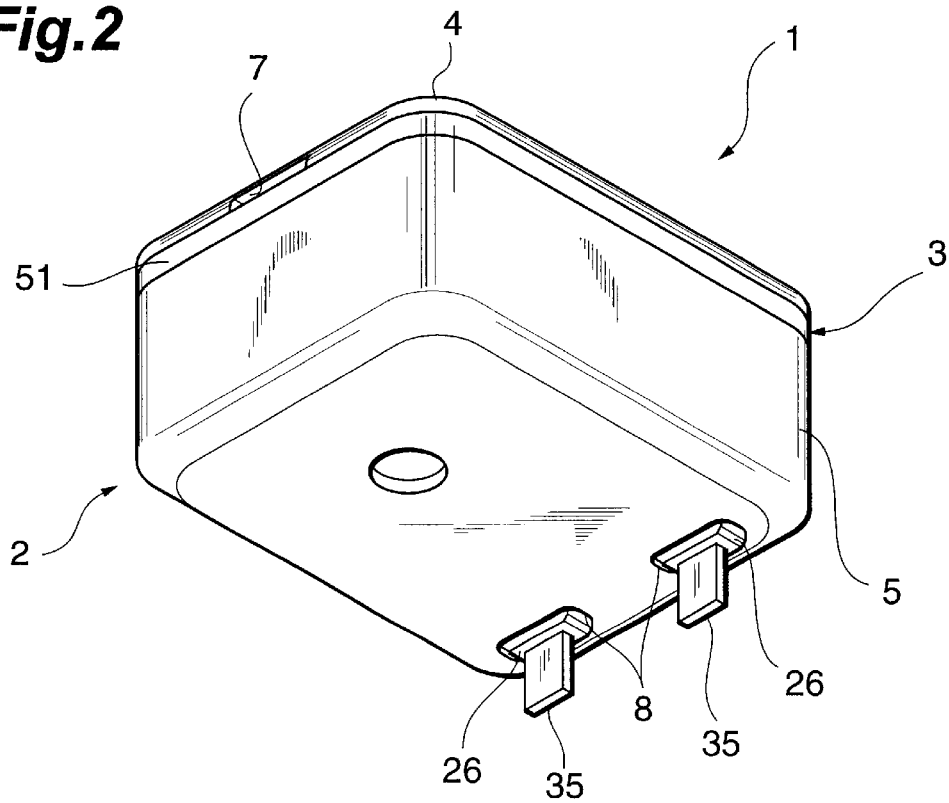
FIG. 2 is a perspective view showing the overall external appearance of the electroacoustic transducer according to the embodiment of the invention.
Figure 3:
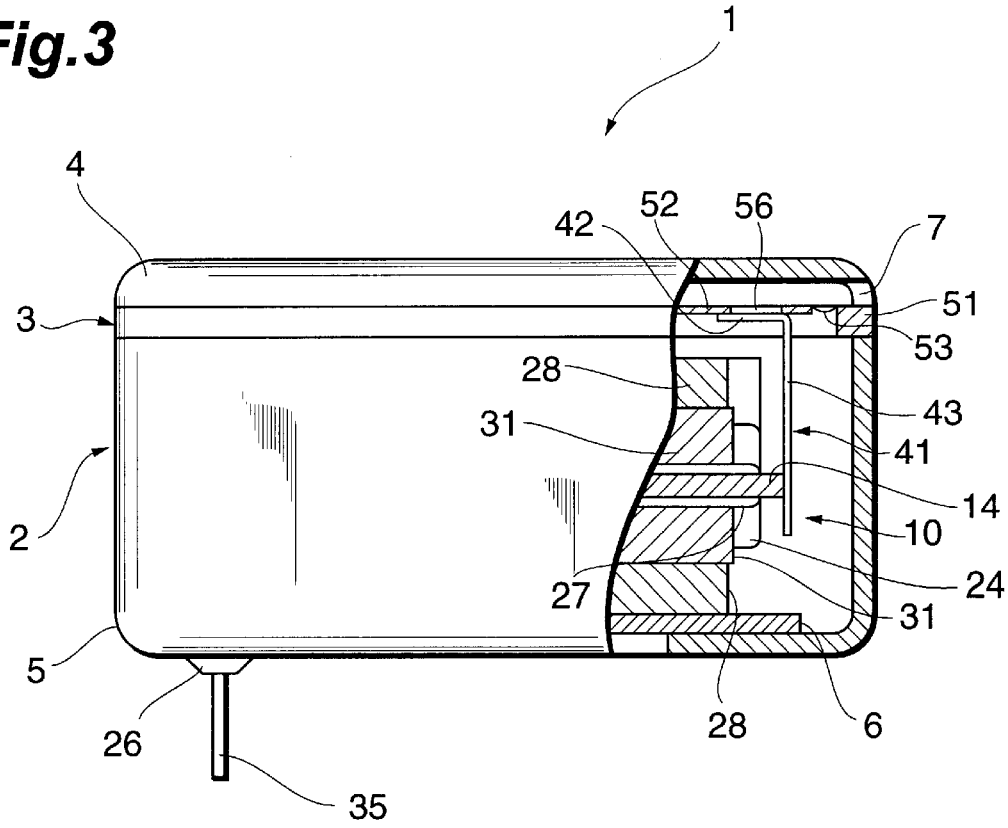
FIG. 3 is a side view of the electroacoustic transducer according to the embodiment of the invention with its housing partially cut away.
Figure 4:
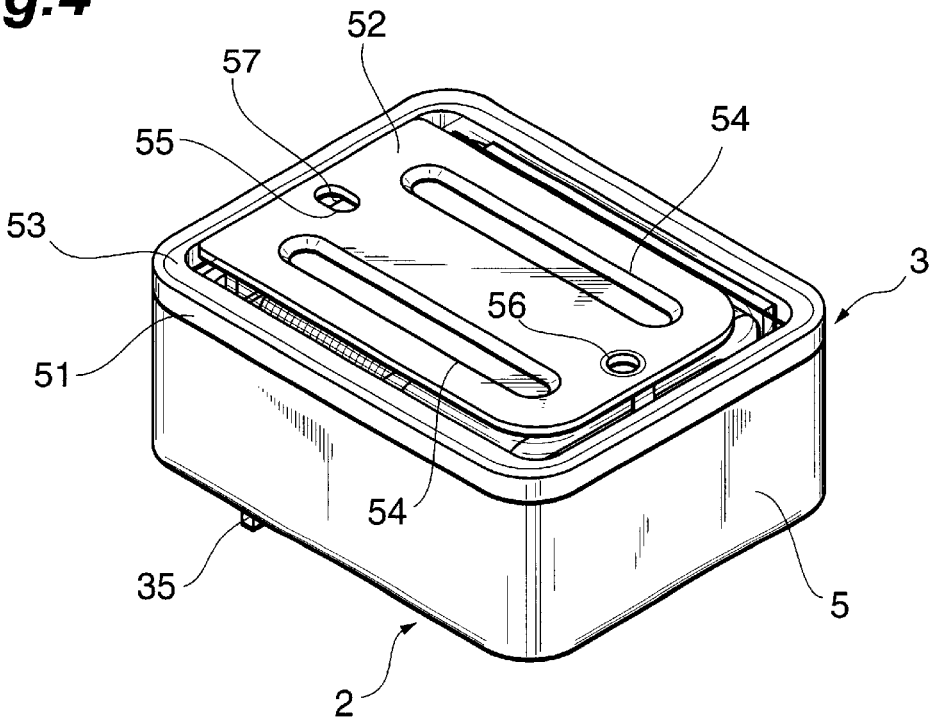
FIG. 4 is a perspective view of the electroacoustic transducer according to the embodiment of the invention with its top housing section removed.
Figure 5:
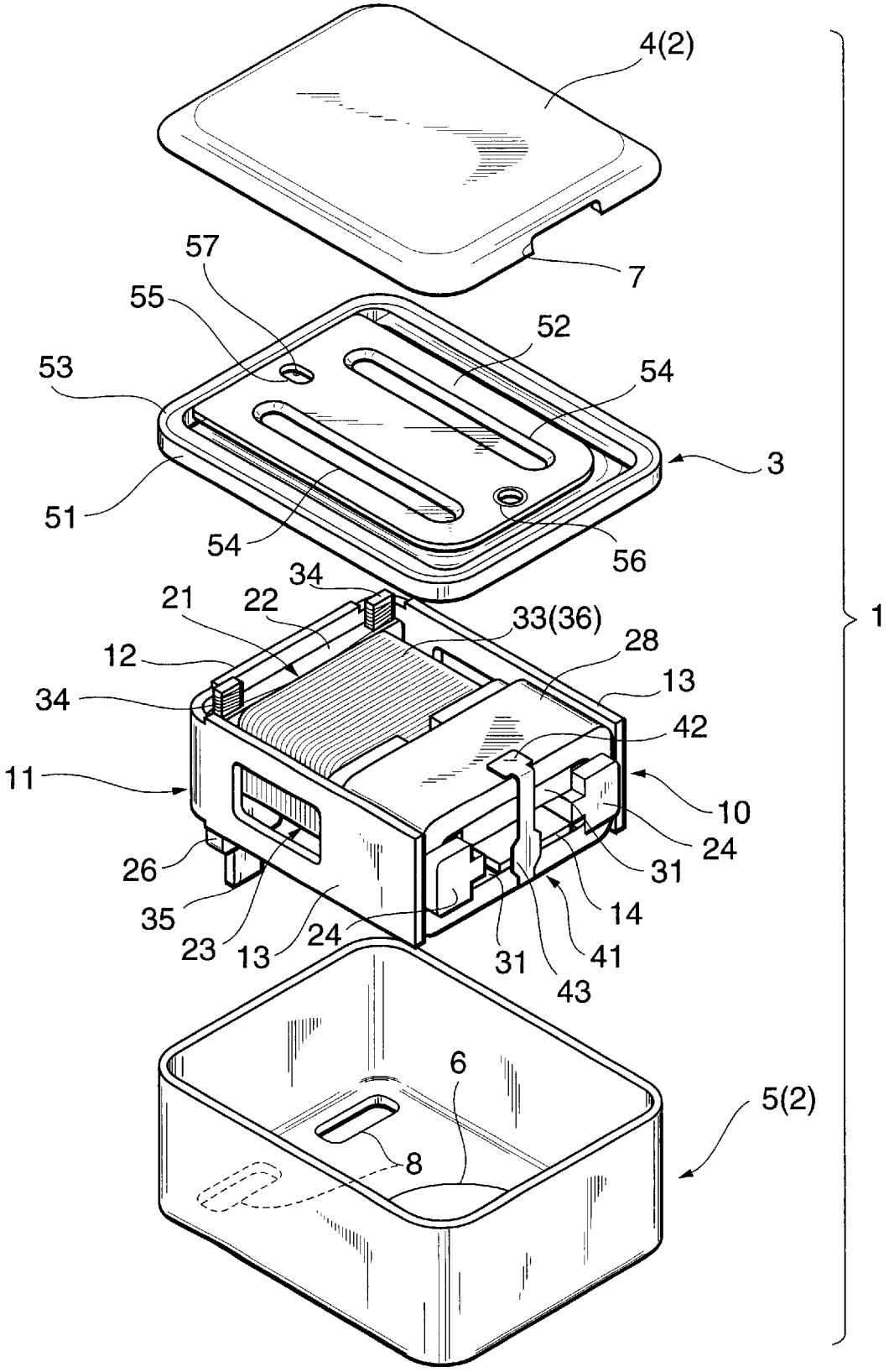
FIG. 5 is an exploded perspective view showing the construction of the electroacoustic transducer according to the embodiment of the invention.
Figure 6:
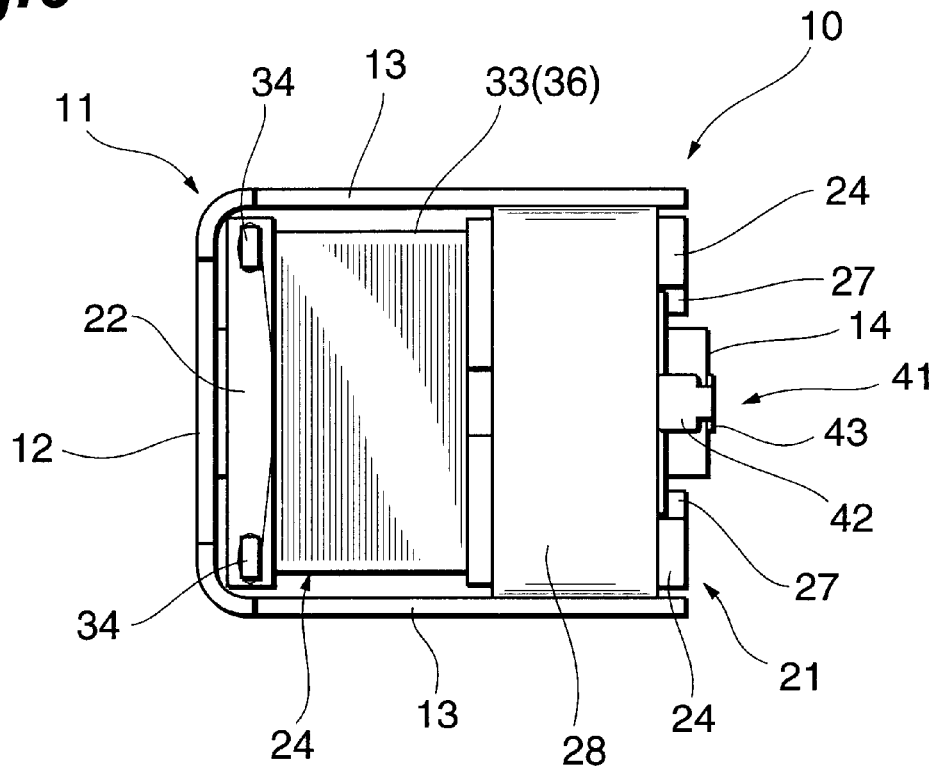
FIG. 6 is a plan view showing the construction of a drive unit incorporated in the electroacoustic transducer according to the embodiment of the invention.
Figure 7:
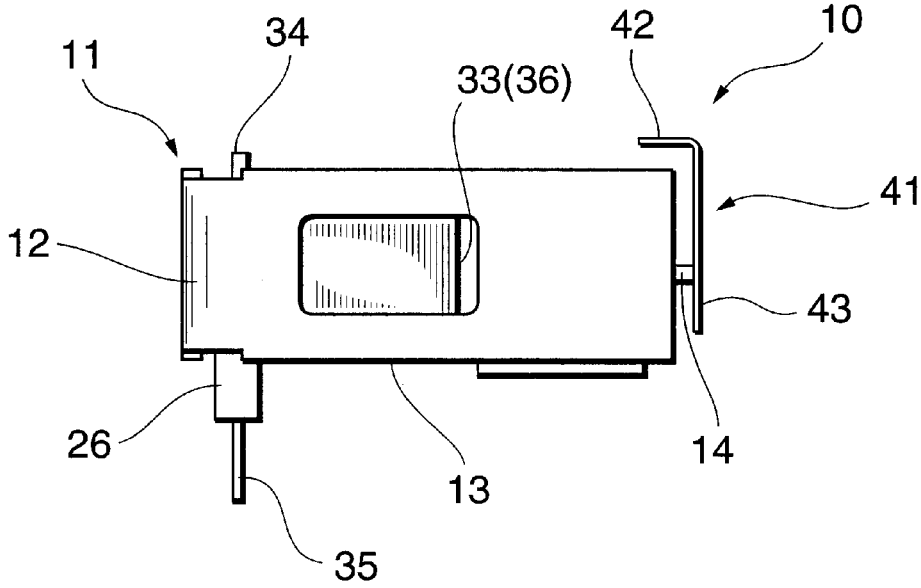
FIG. 7 is a side view showing the construction of the drive unit incorporated in the electroacoustic transducer according to the embodiment of the invention.
Figure 8:
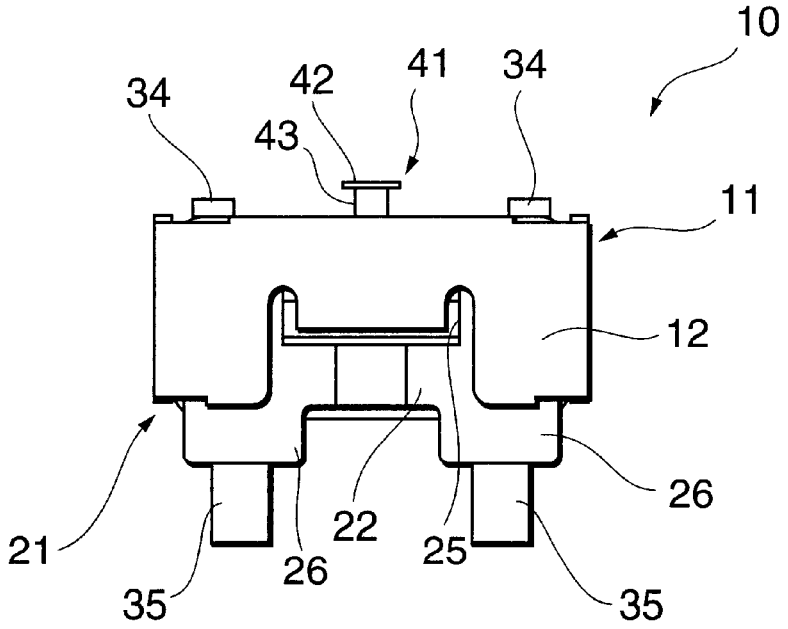
FIG. 8 is a rear view showing the construction of the drive unit incorporated in the electroacoustic transducer according to the embodiment of the invention.
Figure 9:
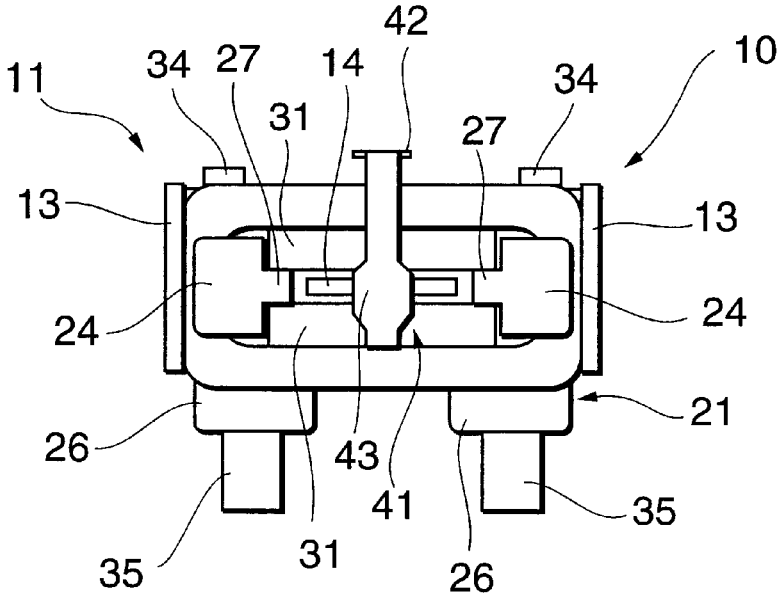
FIG. 9 is a front view showing the construction of the drive unit incorporated in the electroacoustic transducer according to the embodiment of the invention.

Referring to FIGS. 1 and 2, the electroacoustic transducer 1 comprises a housing 2 and a diaphragm unit 3. The housing 2 includes a top housing section 4 and a bottom housing section 5. The top housing section 4 and the bottom housing section 5 are joined together with the diaphragm unit 3 sandwiched in between by laser welding and adhesive bonding, for instance. The bottom housing section 5 has a boxlike structure with its top side opened. This opened top of the bottom housing section 5 is covered by the diaphragm unit 3 as shown in FIG. 4. A drive unit 10 is accommodated in a space enclosed by the bottom housing section 5 and the diaphragm unit 3 as shown in FIGS. 3 and 5. The drive unit 10 is fixed to a spacer 6 provided at the bottom of the bottom housing section 5 by laser welding, for instance. The spacer 6 is attached to the bottom of the bottom housing section 5 by laser welding and adhesive bonding, for instance.

The upper surface of the diaphragm unit 3 is covered by the top housing section 4. There is formed a cutout 7 in a peripheral part of the top housing section 4. As can be seen from FIG. 3, the cutout 7 connects a space enclosed by the diaphragm unit 3 and the top housing section 4 to the exterior of the housing 2. There are formed a pair of through holes 8 in the bottom of the bottom housing section 5 as shown in FIGS. 2 and 5.

Construction of the drive unit 10 is now described referring to FIGS. 6–13. The drive unit 10 includes an armature unit 11, a bobbin unit 21, a pair of magnets 31 and a driving pin 41.

Figure 10:
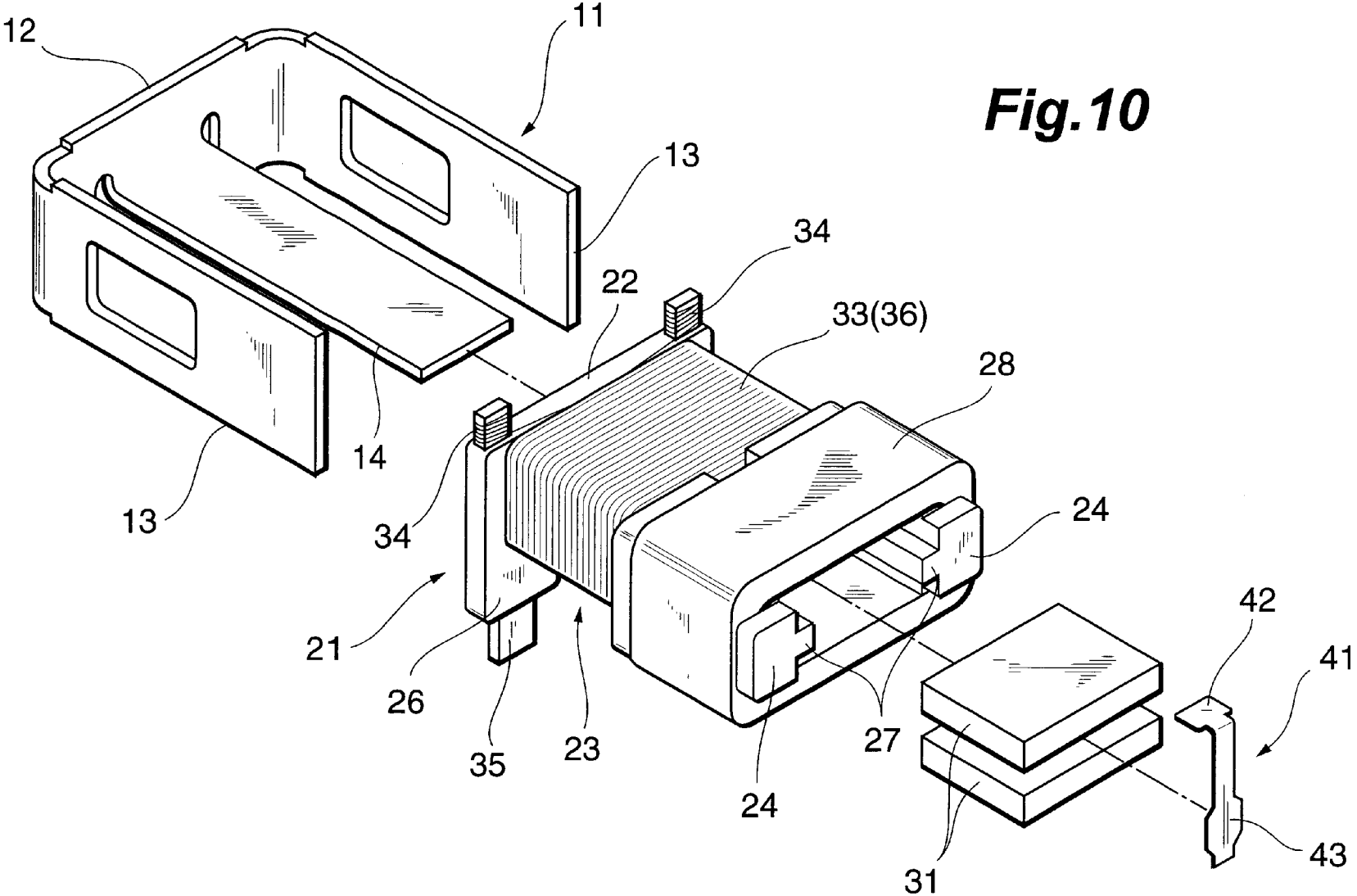
FIG. 10 is an exploded perspective view showing the construction of the drive unit incorporated in the electroacoustic transducer according to the embodiment of the invention.
Figure 23:
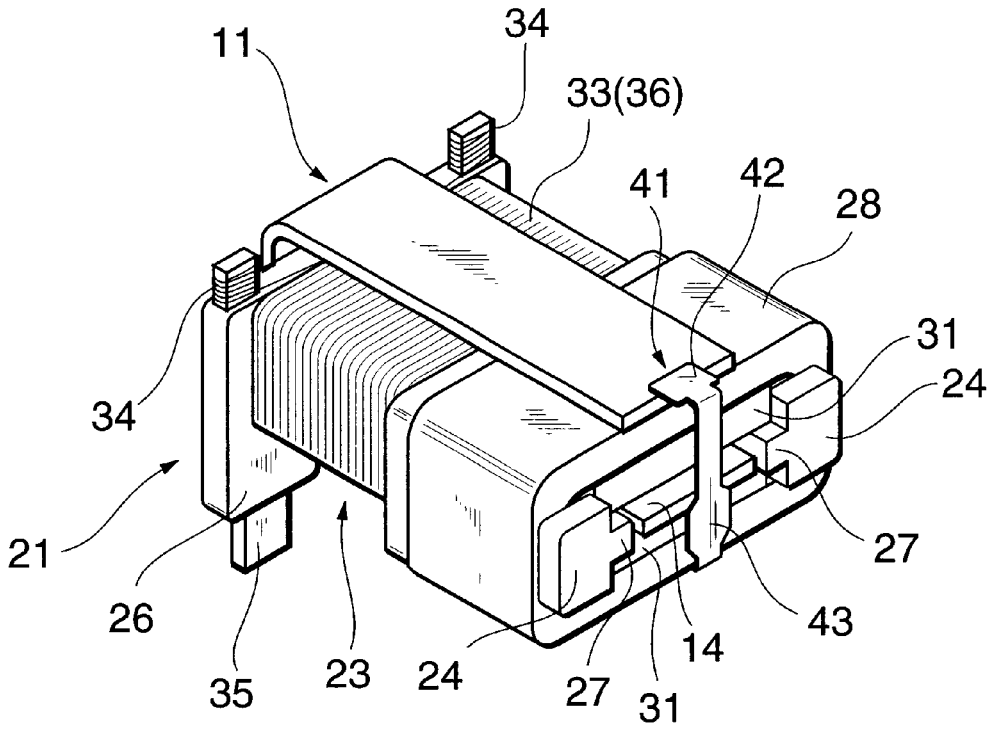
FIG. 23 is a perspective view showing the construction of an armature unit incorporated in the electroacoustic transducer according to a variation of the embodiment of the invention.
Figure 24:
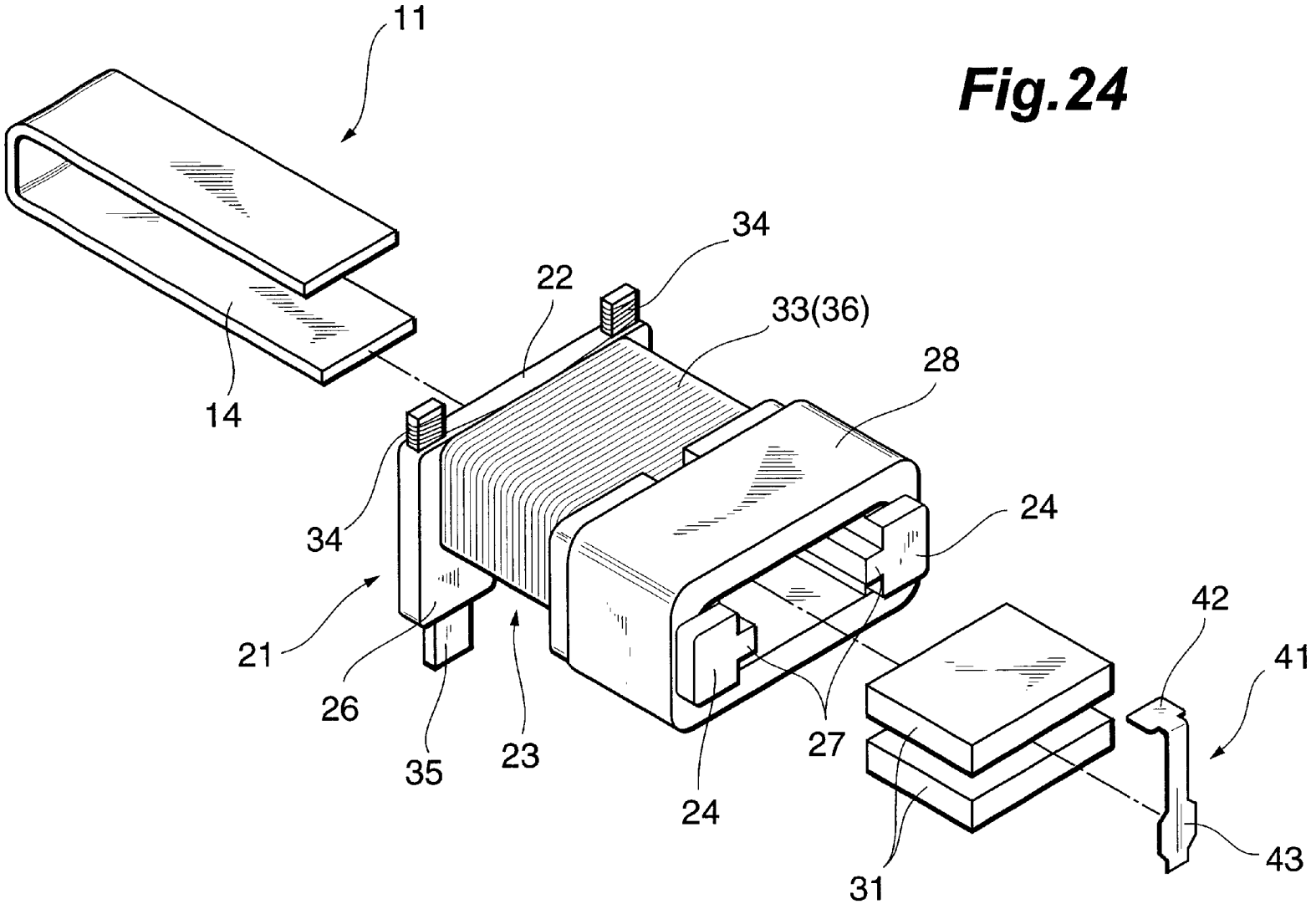
FIG. 24 is an exploded perspective view showing the construction of the armature unit incorporated in the electroacoustic transducer according to the variation of the embodiment of the invention.

The armature unit 11 is a plate member having a generally E-shaped structure in plan view formed by bending a metal plate as illustrated in FIG. 10. The armature unit 11 includes a base plate portion 12, a pair of side plate portions 13 extending from two opposite ends of the base plate portion 12, and an armature 14 extending between the side plate portions 13, 13 from a central part of the base plate portion 12. In one alternative, the armature unit 11 may be generally U-shaped in side view as illustrated in FIGS. 23 and 24.

Figure 11:
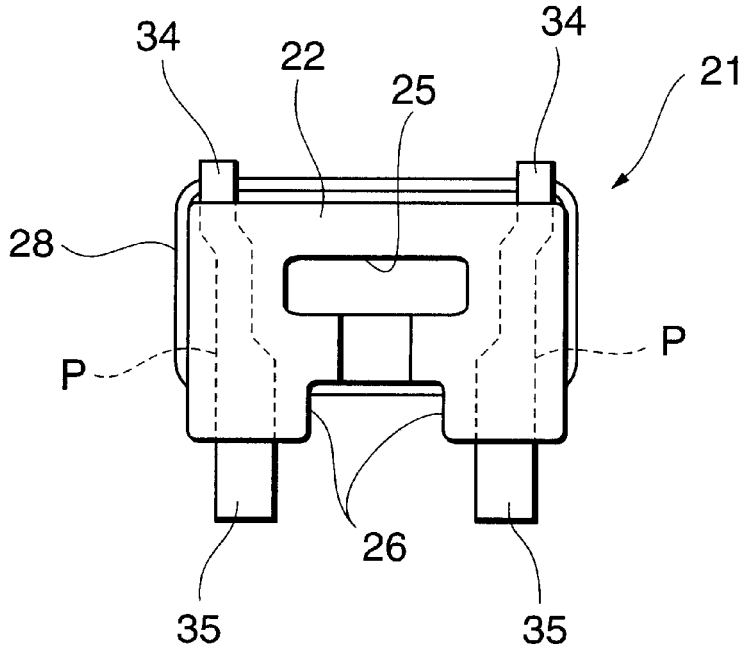
FIG. 11 is a front view showing the construction of a bobbin unit incorporated in the electroacoustic transducer according to the embodiment of the invention.
Figure 12:
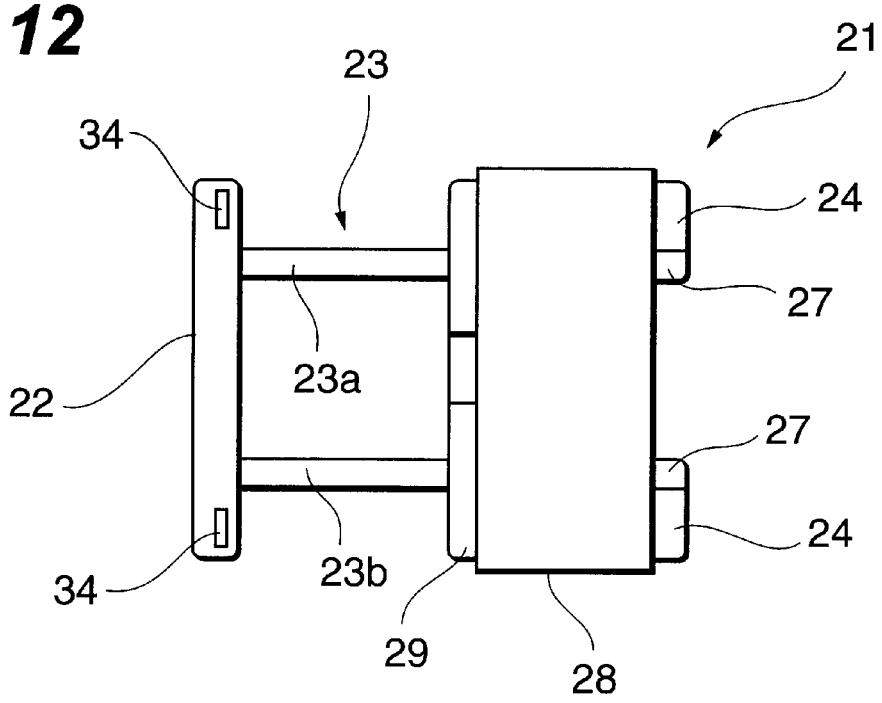
FIG. 12 is a plan view showing the construction of the bobbin unit incorporated in the electroacoustic transducer according to the embodiment of the invention.
Figure 13:
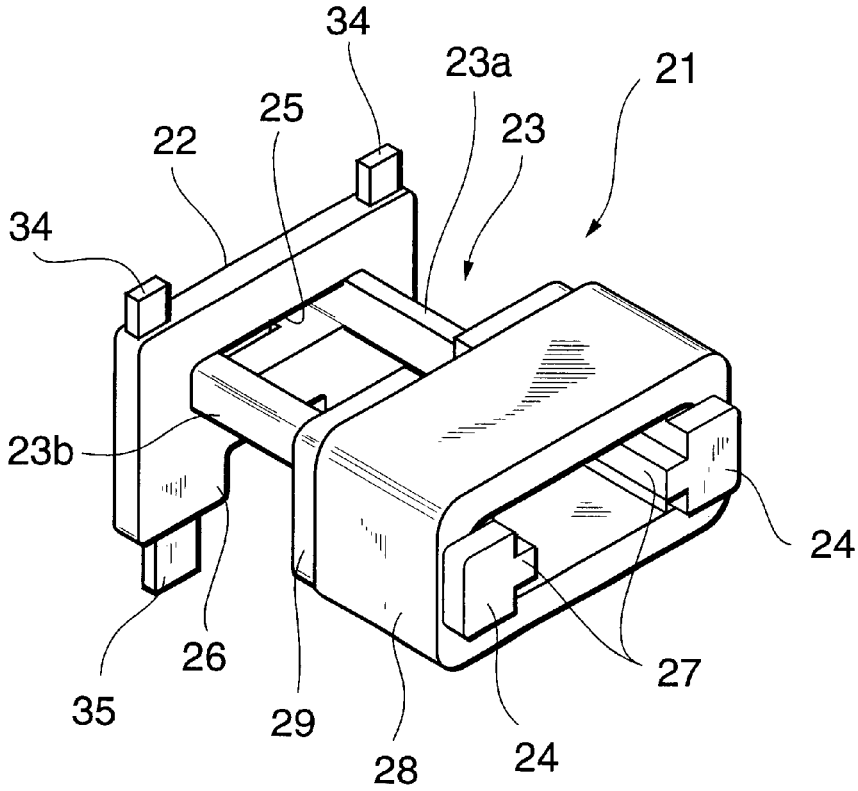
FIG. 13 is a perspective view showing the construction of the bobbin unit incorporated in the electroacoustic transducer according to the embodiment of the invention.

The bobbin unit 21 includes a base portion 22, a coil winding portion 23 on which a conductor 33 is wound, and magnet positioning bars 24 for properly positioning the magnet pair 31 as shown in FIGS. 11–13. The base portion 22, the coil winding portion 23 and the magnet positioning bars 24 are one-piece molded using a resin material.

The base portion 22 constitutes a surface generally parallel to the base plate portion 12 of the armature unit 11 as shown in FIG. 5, and a hole 25 is made in a central part of the base portion 22 as shown in FIG. 13 to allow the armature 14 to pass through the base portion 22. The base portion 22 has a pair of coil side terminals 34 to which ends of the conductor 33 are connected and a pair of signal input terminals 35 to which an external signal is entered. These terminals 34, 35 are provided one each at both ends of the base portion 22 with the hole 25 located in between. The coil side terminals 34 are electrically connected to their corresponding signal input terminals 35 inside the base portion 22. The coil side terminals 34 and the signal input terminals 35 are positioned at both ends of the base portion 22 with the hole 25 located in between as shown in FIG. 11 by inserting a pair of electrically conductive metal strips P into a portion constituting the base portion 22 when the bobbin unit 21 is one-piece molded.

As shown in FIGS. 6, 8, 11 and 13, the base portion 22 has at its portions where the signal input terminals 35 are provided integrally formed projections 26 extending toward extreme ends of the signal input terminals 35. The through holes 8 in the bottom housing section 5 are formed at its locations corresponding to the individual signal input terminals 35 and the projections 26. The signal input terminals 35 and the projections 26 are fit into the respective through holes 8 formed in the bottom of the bottom housing section 5 when the drive unit 10 is assembled with the bottom housing section 5, as shown in FIG. 2. The drive unit 10 is properly positioned in relation to the bottom housing section 5 as the projections 26 are fit into the through holes 8 in this manner. When the drive unit 10 has been fixed to the bottom housing section 5, part of the projections 26 and the signal input terminals 35 project to the outside of the housing 2 as shown in FIGS. 2 and 3. An adhesive is applied between the projections 26 and the through holes 8.

The coil winding portion 23 of the bobbin unit 21 is formed of a pair of arms 23*a*, 23*b* provided at a specific distance from each other as shown in FIGS. 12 and 13. The two arms 23*a*, 23*b* are connected between the base portion 22 and a wall portion 29 of the bobbin unit 21. A coil 36 is formed by winding the conductor 33 over the two arms 23*a*, 23*b*. The conductor 33 used in this embodiment is a copper wire measuring about 25 $\mu$m in diameter, which is wound about 1000 times on the coil winding portion 23. The ends of the conductor 33 are wound around the respective coil side terminals 34 and fixed thereto by arc welding.

Figure 14:
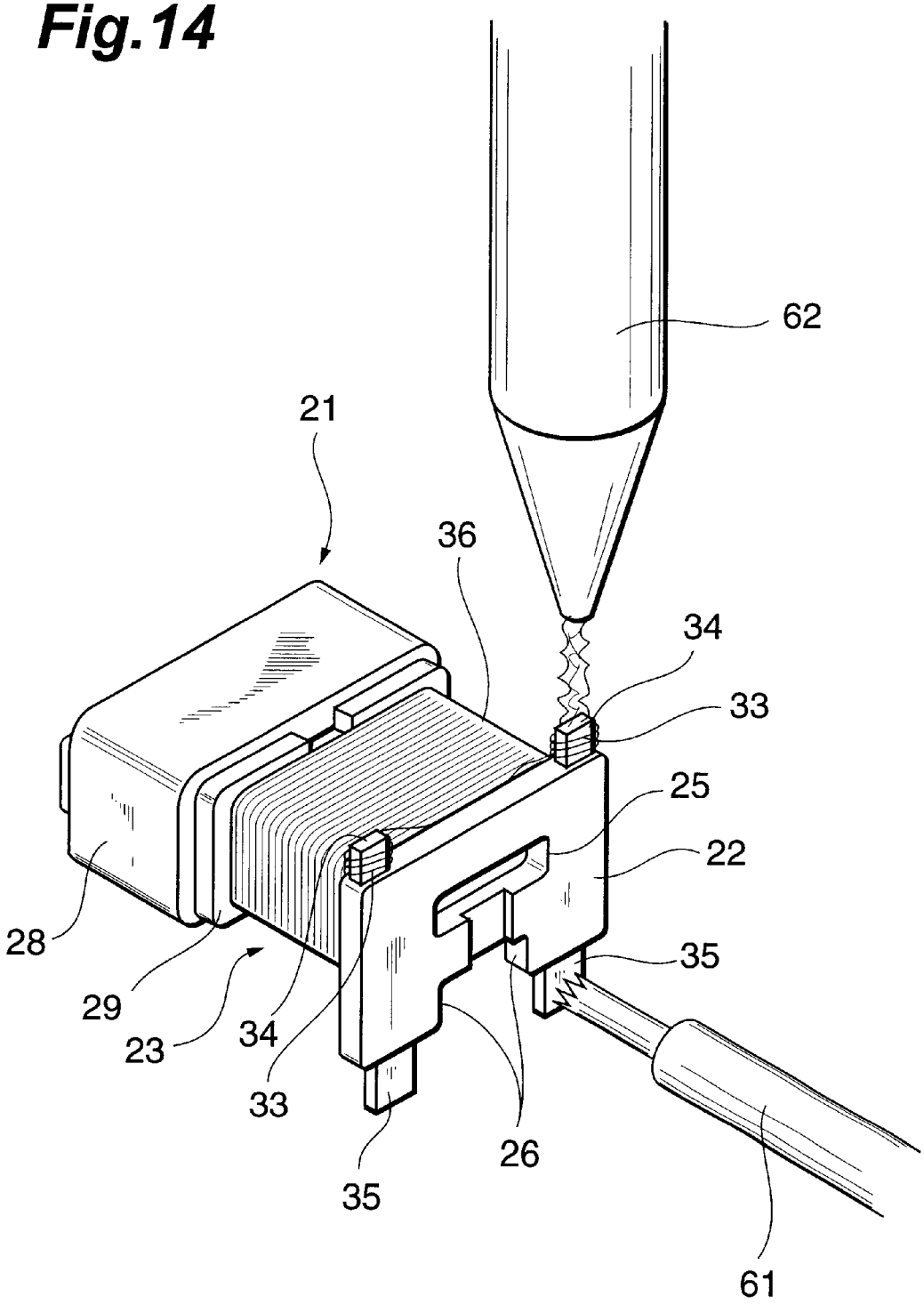
FIG. 14 is a perspective view schematically showing a process of fixing a conductor to a coil side terminal tab in the electroacoustic transducer according to the embodiment of the invention.

The arc welding operation is performed by holding an electrode 62 for arc welding close to one of the coil side terminals 34 with a grounding pin 61 maintained in contact with the corresponding signal input terminal 35 so that the distance from the tip of the arc-welding electrode 62 to the signal input terminal 35 is larger than the distance from the tip of the arc-welding electrode 62 to the coil side terminal 34 as shown in FIG. 14. The distance from the tip of the arc-welding electrode 62 to the signal input terminal 35 is kept larger than the distance from the tip of the arc-welding electrode 62 to the coil side terminal 34 in this manner to prevent the occurrence of an arc between the tip of the arc-welding electrode 62 and the signal input terminal 35. As a consequence, it becomes possible to produce an arc between the tip of the arc-welding electrode 62 and the coil side terminal 34 in a reliable fashion and securely fix each end of the conductor 33 to the respective coil side terminal 34.

The magnet positioning bars 24 are provided as if extending from the wall portion 29 as shown in FIGS. 12 and 13. There are formed gap setting parts 27 on the individual magnet positioning bars 24 for setting the two magnets 31 in position with a specific distance therebetween. There is formed a clearance between the two magnets 31 as the magnets 31 sandwich the gap setting parts 27, such that an end portion of the armature 14 can be inserted between the two magnets 31. The magnets 31 are fixed to a magnet retainer 28 provided outside the magnet positioning bars 24 by adhesive bonding, for instance. The magnet retainer 28 is made of a magnetic substance which is different from the material of the magnet positioning bars 24 (bobbin unit 21). The magnet retainer 28 is integrally molded with the magnet positioning bars 24 (bobbin unit 21). This is achieved by positioning the magnet retainer 28 outside the magnet positioning bars 24 when the bobbin unit 21 is one-piece molded. However, it is not absolutely necessary to provide the magnet retainer 28 integrally with the magnet positioning bars 24 (bobbin unit 21) when the bobbin unit 21 is formed as a single structure. Instead, the magnet retainer 28 may be fixed to the bobbin unit 21 by adhesive bonding, for instance, after the bobbin unit 21 has been one-piece molded.

The driving pin 41 includes a diaphragm-side flat portion 42 and an armature-side flat portion 43. The diaphragm-side flat portion 42 extends generally parallel to a later-described diaphragm 52. The armature-side flat portion 43 extends generally at right angles to the diaphragm-side flat portion 42 and is fixed to an end portion of the armature 14. The diaphragm-side flat portion 42 and the armature-side flat portion 43 are one-piece formed by bending a metal plate in a generally L shape.

The armature unit 11 and the bobbin unit 21 are assembled in such a way that the end portion of the armature 14 projects from a far end of the bobbin unit 21 (magnet positioning bars 24) as shown in FIGS. 6–9. This is achieved by inserting the armature 14 into the hole 25 in the base portion 22 and having the armature 14 through the coil 36 and the two magnets 31. Assembly of the armature unit 11 and the bobbin unit 21 is completed by fixing the side plate portions 13 of the armature unit 11 to the magnet retainer 28 by laser welding, for instance. When the armature unit 11 and the bobbin unit 21 have been assembled in this manner, there is formed a clearance between the base portion 22 of the bobbin unit 21 and the base plate portion 12 of the armature unit 11. This prevents direct contact between the base portion 22 and the base plate portion 12 and prohibits the bobbin unit 21 (base portion 22) from adversely affecting vibrations of the armature 14.

The armature-side flat portion 43 of the driving pin 41 is fixed to the end portion of the armature 14 projecting from the far end of the bobbin unit 21 (magnet positioning bars 24) as shown in FIGS. 6–9 by laser welding, for instance. The driving pin 41 has an integrally formed positioning part (not shown) which is used fixing the armature-side flat portion 43 to the end portion of the armature 14. This positioning part is cut away from the driving pin 41 (armature-side flat portion 43) after the armature-side flat portion 43 has been fixed to the end portion of the armature 14.

Figure 15:
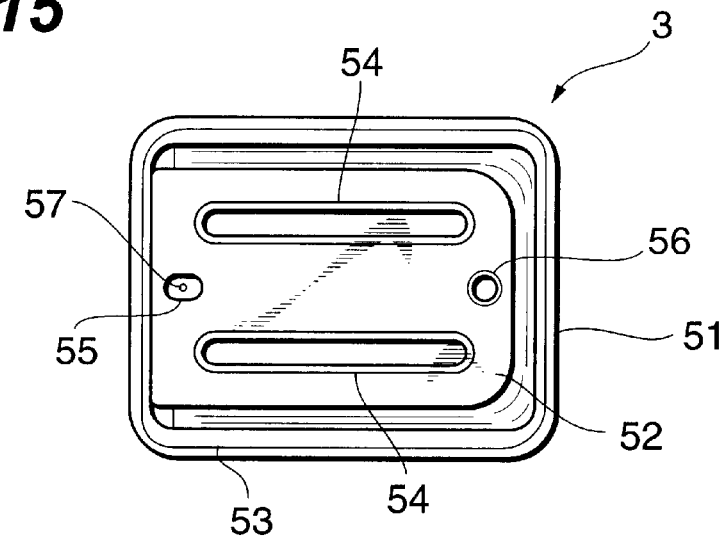
FIG. 15 is a plan view of a diaphragm unit incorporated in the electroacoustic transducer according to the embodiment of the invention.
Figure 16:
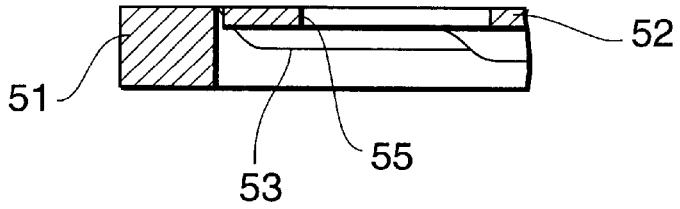
FIG. 16 is an enlarged fragmentary cross-sectional view of the diaphragm unit incorporated in the electroacoustic transducer according to the embodiment of the invention.
Figure 17:
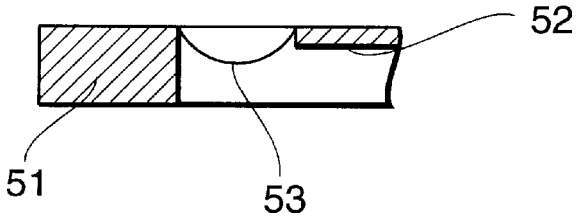
FIG. 17 is an enlarged fragmentary cross-sectional view of the diaphragm unit incorporated in the electroacoustic transducer according to the embodiment of the invention.
Figure 18:
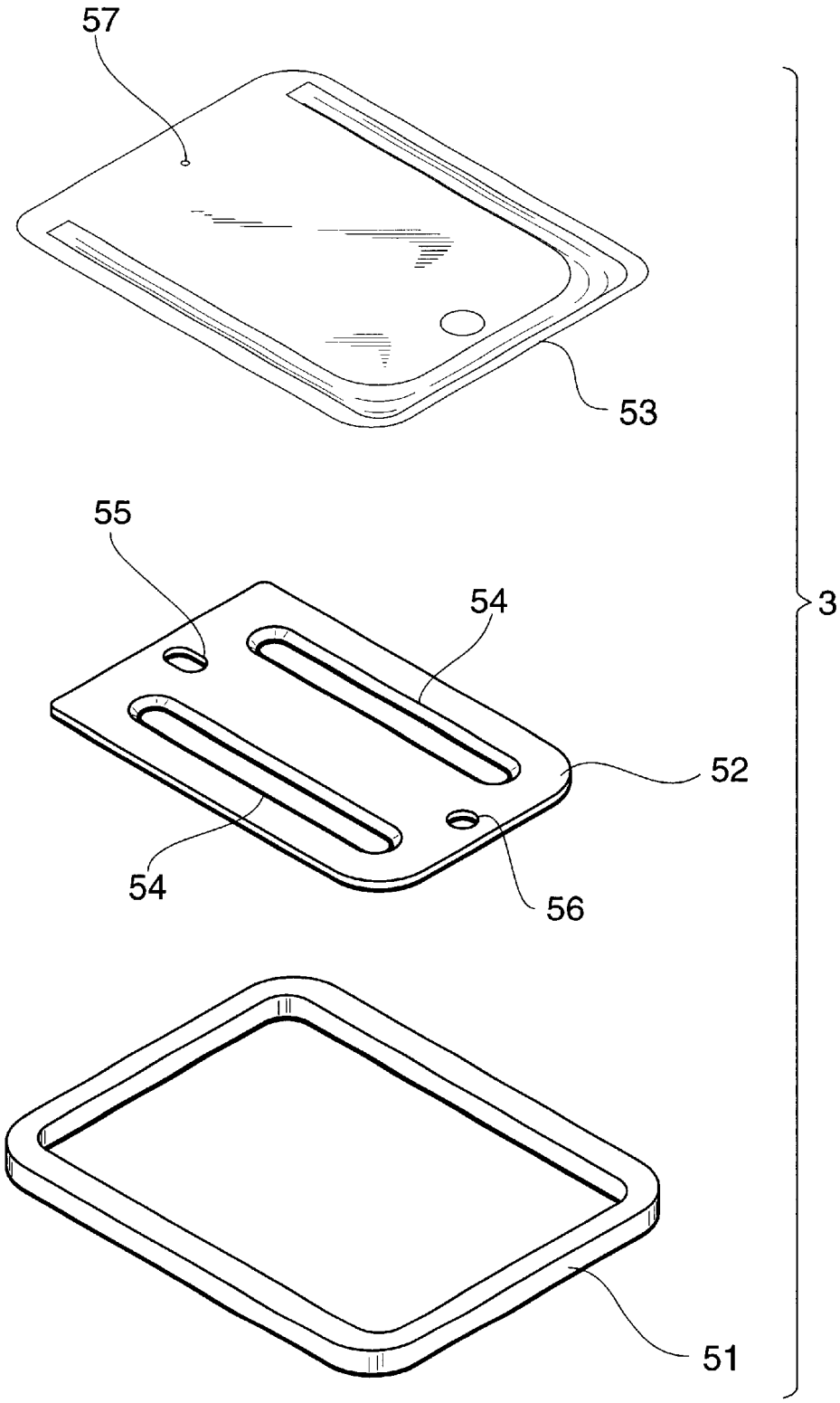
FIG. 18 is an exploded perspective view showing the construction of the diaphragm unit incorporated in the electroacoustic transducer according to the embodiment of the invention.

Construction of the diaphragm unit 3 is now described referring to FIGS. 15–18. The diaphragm unit 3 includes a diaphragm frame 51, a diaphragm 52 which is a generally flat-shaped vibrating plate, and a thermoplastic resin film 53 serving as a vibrating membrane (diaphragm sheet) as shown in FIGS. 15 and 18. This diaphragm sheet may be made of silicone rubber, for example, instead of the thermoplastic resin film.

The diaphragm 52 is located inside the diaphragm frame 51 as shown in FIG. 15. The resin film 53 is fixed to upper surfaces of the diaphragm frame 51 and the diaphragm 52. The resin film 53 holds the diaphragm 52 allowing its vibration relative to the diaphragm frame 51. The resin film 53 is fixed to the diaphragm frame 51 and the diaphragm 52 by applying an adhesive to the upper surfaces of the diaphragm frame 51 and the diaphragm 52, and then bonding them together by use of heat and pressure. Portions of the resin film 53 corresponding to gaps between the diaphragm frame 51 and the diaphragm 52 bulge out toward the space enclosed by the bottom housing section 5 and the diaphragm unit 3, forming a generally convexity arc-shaped cross section as shown in FIG. 17. Since the portions of the resin film 53 corresponding to the gaps between the diaphragm frame 51 and the diaphragm 52 are to form the generally arc-shaped cross section, it is possible to ensure an adequate amplitude of the diaphragm 52 and suppress hindrance to vibration of the diaphragm 52.

The diaphragm 52 has a generally rectangular shape in plan view and recesses 54 are formed in the diaphragm 52 to provide it with stiffness. A hole 55 and a driving pin fixing hole 56 for fixing the driving pin 41 are formed in a flat portion of the diaphragm 52 where the resin film 53 is fixed.

The driving pin fixing hole 56 is formed at a position corresponding to the diaphragm-side flat portion 42 of the driving pin 41. The hole 55 and the driving pin fixing hole 56 are formed close to short sides of the diaphragm 52 with a specific distance from each other in a longitudinal direction of the diaphragm 52.

The hole 55 formed in the flat portion of the diaphragm 52 is covered with the resin film 53. There is formed a vent hole 57 in an area of the resin film 53 corresponding to the hole 55. This vent hole 57 serves to regulate pressure differences between the space enclosed by the diaphragm unit 3 and the top housing section 4 (that is connected to the exterior of the housing 2) and the space enclosed by the bottom housing section 5 and the diaphragm unit 3. In other words, the vent hole 57 serves to regulate pressure differences between chambers formed on both sides of the diaphragm unit 3 (including the diaphragm 52 and the resin film 53). The vent hole 57, which is formed by projecting a laser beam, is made approximately 30 $\mu$m large in diameter in this embodiment.

The driving pin fixing hole 56 is also covered by the resin film 53, like the hole 55, when the resin film 53 has been fixed to the diaphragm 52. However, a portion of the resin film 53 covering the driving pin fixing hole 56 is removed by laser beam irradiation over an area whose diameter is larger than that of the driving pin fixing hole 56.

When the resin film 53 is fixed to the diaphragm frame 51 and the diaphragm 52, the diaphragm frame 51 and the diaphragm 52 are positioned relative to each other in a condition where a specific clearance is formed in between as shown in FIG. 16, such that the diaphragm frame 51 would not adversely affect the vibration of the diaphragm 52. Positioning of the diaphragm 52 is made by inserting positioning pins (not shown) into the hole 55 and the driving pin fixing hole 56. Further, positioning of the diaphragm frame 51 is made by holding its outside by a positioning jig (not shown).

It is possible to utilize the hole 55 and the driving pin fixing hole 56 as positioning holes for the diaphragm 52 and position the diaphragm 52 in a reliable fashion when fixing the resin film 53 to the diaphragm frame 51 and the diaphragm 52. It is also possible to simplify manufacturing process for forming the diaphragm unit 3 as it is not necessary to make dedicated positioning holes.

The bottom housing section 5 and the diaphragm unit 3 are fixed together by laser welding and adhesive bonding, for instance, in a condition where the opened top of the bottom housing section 5 in which the drive unit 10 is fixed is covered by the diaphragm unit 3. Since the driving pin fixing hole 56 is formed in the diaphragm 52 at its position corresponding to the diaphragm-side flat portion 42, the diaphragm-side flat portion 42 is located immediately beneath the driving pin fixing hole 56 when the bottom housing section 5 and the diaphragm unit 3 (diaphragm frame 51) have been fixed together. The diaphragm-side flat portion 42 is fixed to the driving pin fixing hole 56 by applying (injecting) an adhesive to the diaphragm-side flat portion 42 through the driving pin fixing hole 56 in a condition where the diaphragm-side flat portion 42 has been positioned beneath the driving pin fixing hole 56.

In order to firmly fix the diaphragm-side flat portion 42 to the driving pin fixing hole 56, it is preferable to provide a specified clearance between the diaphragm-side flat portion 42 and the diaphragm 52 to allow the adhesive to flow in when the bottom housing section 5 and the diaphragm unit 3 (diaphragm frame 51) have been fixed together.

In certain cases, the diaphragm-side flat portion 42 (driving pin 41) comes in contact with and presses against the diaphragm 52 when the bottom housing section 5 and the diaphragm unit 3 (diaphragm frame 51) are fixed together due to dimensional errors in various components that occur during their molding process or due to their misalignment occurring during their assembly, for instance. Since the adhesive is applied (injected) into the driving pin fixing hole 56, it is possible to fix the diaphragm-side flat portion 42 to the driving pin fixing hole 56 in a reliable fashion even in a condition where the diaphragm-side flat portion 42 (driving pin 41) presses against the diaphragm 52. Furthermore, a pressing force applied by the diaphragm-side flat portion 42 (driving pin 41) onto diaphragm 52 can be absorbed by displacement of the diaphragm 52. Even when a clearance larger than the specified clearance is formed between the diaphragm-side flat portion 42 and the diaphragm 52, it is possible to fill that clearance with the adhesive.

Due to the provision of the driving pin fixing hole 56 for the application (injection) of the adhesive formed in the diaphragm 52, it is possible to check whether the diaphragm 52 and the driving pin 41 are fixed together by visual inspection through the driving pin fixing hole 56. If fixing between the diaphragm 52 and the driving pin 41 is insufficient, then it would be possible to reapply (reinject) the adhesive through the driving pin fixing hole 56, thereby fixing the diaphragm 52 and the driving pin 41 in a more reliable fashion.

Now, operation of the electroacoustic transducer 1 thus constructed is described below. In the electroacoustic transducer 1 of the embodiment, the magnet pair 31 forms a magnetic circuit and a non-alternating magnetic field is produced between the two magnets 31. If a signal is applied to the coil 36 through the signal input terminals 35, there is produced an alternating magnetic flux. When this alternating magnetic flux flows through a magnetic circuit formed of the armature 14, the magnet pair 31, the magnet retainer 28, the side plate portions 13 and the base plate portion 12 of the armature unit 11, an alternating magnetic flux occurs between the magnet pair 31 and the armature 14. As this alternating magnetic flux is superimposed on the aforementioned non-alternating magnetic field, the armature 14 is caused to vibrate. The vibration of the armature 14 is transmitted to the diaphragm 52 through the driving pin 41, thereby causing the diaphragm 52 to vibrate. The vibration of the diaphragm 52 causes the pressure in the space enclosed by the diaphragm unit 3 and the top housing section 4 to fluctuate. This pressure fluctuation is transmitted to the exterior of the electroacoustic transducer 1 through the cutout 7 in the top housing section 4 in the form of sound waves.

The electroacoustic transducer 1 of the embodiment is provided with the bobbin unit 21 as previously mentioned, and the bobbin unit 21 includes the base portion 22 one-piece molded with the coil side terminals 34 to which the ends of the conductor 33 are connected and the signal input terminals 35 which are electrically connected to the coil side terminals 34, as well as the coil winding portion 23 on which the conductor 33 is wound to form the coil 36. The conductor 33 is electrically connected to the signal input terminals 35 when the ends of the conductor 33 are connected to the coil side terminals 34 provided at the base portion 22 of the bobbin unit 21. This arrangement facilitates connection of the ends of the conductor 33 constituting the coil 36 to the signal input terminals 35. Furthermore, since the coil side terminals 34 are provided at the base portion 22 of the bobbin unit 21 and the coil 36 is formed on the coil winding portion 23 of the bobbin unit 21, it is possible to shorten the length of lead wire portions between the coil 36 and the coil side terminals 34 and thereby prevent breakage of the conductor 33 between the coil 36 and the coil side terminals 34.

In the electroacoustic transducer 1 of the embodiment, the bobbin unit 21 includes the base portion 22, the coil winding portion 23, the magnet positioning bars 24 and the magnet retainer 28 while the armature unit 11 includes the base plate portion 12, the two side plate portions 13 and the armature 14. Also, the signal input terminals 35 and the coil side terminals 34 are provided at both ends of the base portion 22 with the hole 25 located in between. This construction makes it easy to arrange the signal input terminals 35 and the coil side terminals 34 on the base portion 22 in which the hole 25 is formed.

Moreover, since the signal input terminals 35 and the coil side terminals 34 are provided at both ends of the base portion 22 with the hole 25 located in between in the electroacoustic transducer 1 of the embodiment, the signal input terminals 35 and the coil side terminals 34 are separated from each other. Therefore, the distance from the tip of the arc-welding electrode 62 to each signal input terminal 35 becomes larger than the distance from the tip of the arc-welding electrode 62 to the corresponding coil side terminal 34 when the ends of the conductor 33 are connected to the coil side terminals 34 by arc welding. This helps prevent the occurrence of an arc between the tip of the arc-welding electrode 62 and the signal input terminals 35 and produce an arc between the tip of the arc-welding electrode 62 and the coil side terminals 34 in a reliable fashion. All these features of the present embodiment ensure reliable connection of the ends of the conductor 33 to the coil side terminals 34.

In the electroacoustic transducer 1 of the embodiment, the base portion 22, the coil winding portion 23 and the magnet positioning bars 24 of the bobbin unit 21 are one-piece molded using a resin material. This makes it possible to reduce the number of components constituting the bobbin unit 21 and facilitate winding of the conductor 33 on the bobbin unit 21 (coil winding portion 23) and its assembly including fixing of the magnets 31.

The electroacoustic transducer 1 of the embodiment comprises the bottom housing section 5 (housing 2) in which the bobbin unit 21 is accommodated, and the through holes 8 are formed in the bottom of the bottom housing section 5 at the locations corresponding to the individual signal input terminals 35. When the bobbin unit 21 is located as a main part of the drive unit 10 in the bottom housing section 5, the signal input terminals 35 project to the exterior of the bottom housing section 5 from its bottom through the two through holes 8. With this arrangement, it becomes possible to provide a construction in which the signal input terminals 35 are exposed to the exterior of the bottom housing section 5 (housing 2) in a simple and inexpensive way.

Furthermore, the projections 26 integrally formed on the base portion 22 of the bobbin unit 21 constitute positioning parts for setting the drive unit 10 in position relative to the bottom housing section 5 in the electroacoustic transducer 1 of the embodiment. With this, it is possible to provide a construction of positioning parts which enables correct and reliable positioning of the armature unit 11 and the bobbin unit 21 of the drive unit 10 in relation to the bottom housing section 5 (housing 2) in a simple and inexpensive way.

Figure 19:
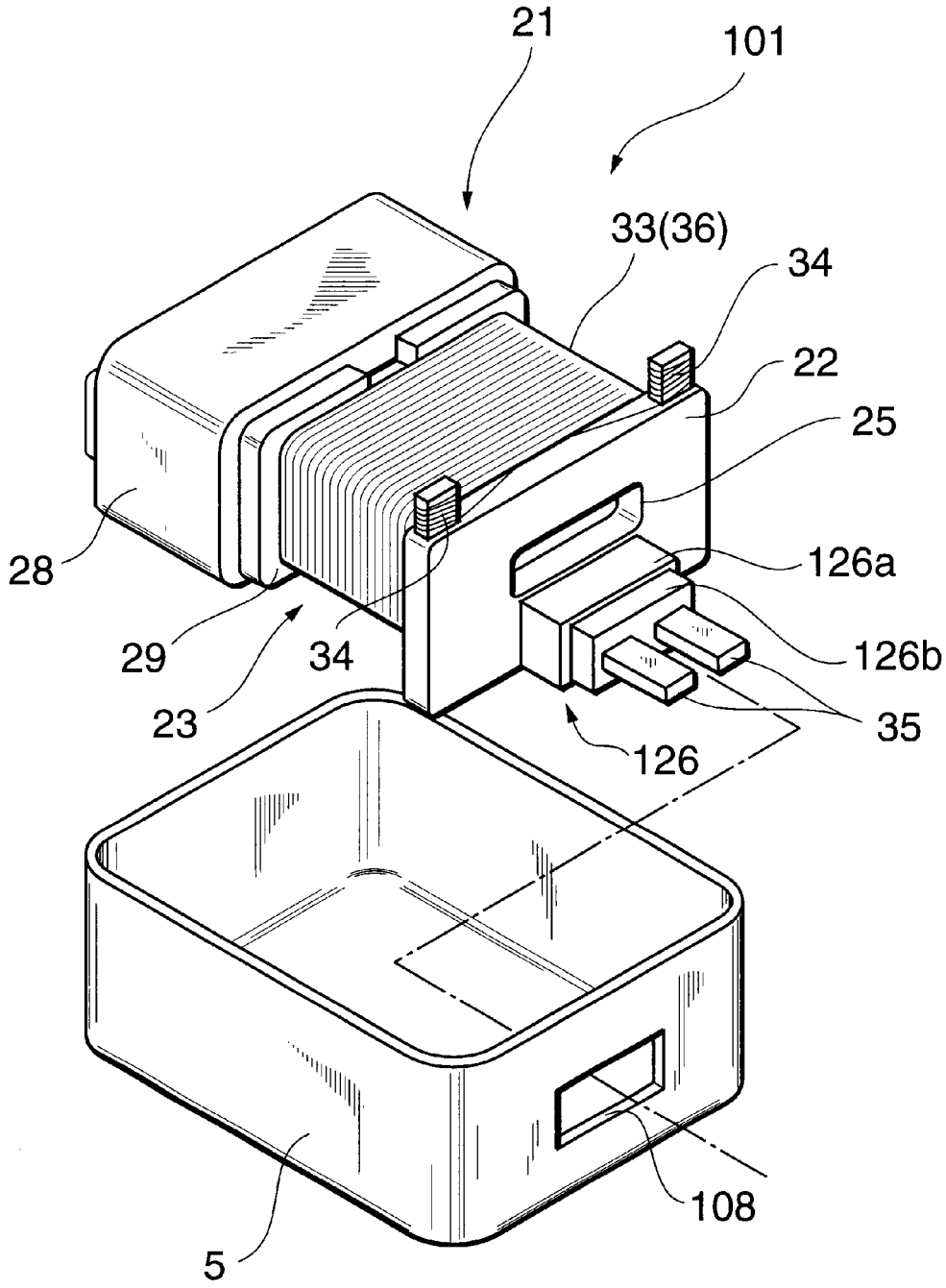
FIG. 19 is an exploded perspective view showing the construction of an electroacoustic transducer according to a variation of the embodiment of the invention.

A variation of the foregoing embodiment is now described with reference to FIGS. 19 and 20. A electroacoustic transducer 101 shown in FIGS. 19 and 20 differs from the electroacoustic transducer 1 shown in FIGS. 1–18 in the construction of a through hole 108 and a projection 126. FIG. 19 shows a bottom housing section 5 and a bobbin unit 21 only, omitting illustration of the other constituent parts.

Figure 20:
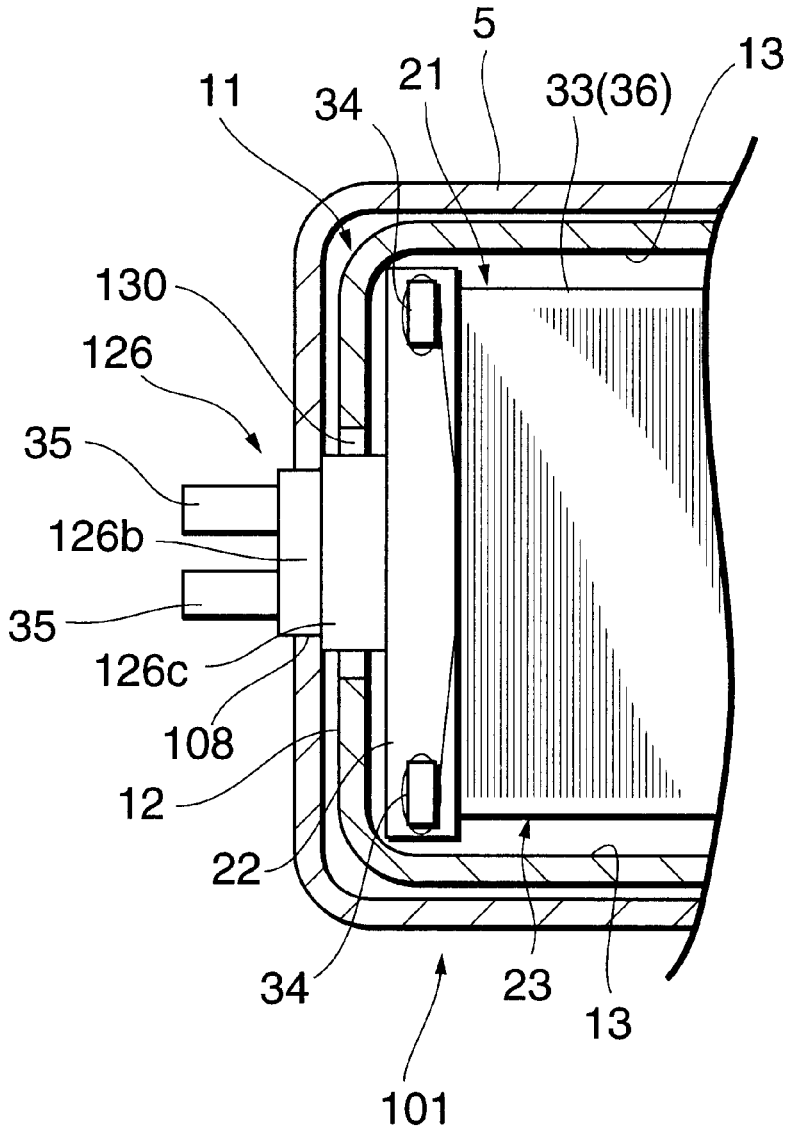
FIG. 20 is an enlarged fragmentary plan view showing the construction of the electroacoustic transducer of FIG. 19.

In the electroacoustic transducer 101 of this variation, the projection 126 is formed integrally with the base portion 22 on a surface of the base portion 22 opposed to the base plate portion 12 of the armature unit 11 as depicted in FIGS. 19 and 20. The projection 126 is located on the opposite side of the coil side terminals 34 with respect to the hole 25. The signal input terminals 35 extend in a direction generally at right angles to the surface of the base portion 22 (opposed to the base plate portion 12 of the armature unit 11) on which the projection 126 is formed. The signal input terminals 35 and the coil side terminals 34 are provided on opposite sides with the hole 25 located in between. The through hole (opening) 108 in the bottom housing section 5 is formed at its location corresponding to the signal input terminals 35 and the projection 126.

The projection 126 is formed into a steplike shape having a first raised part 126*a* and a second raised part 126*b*. The projection 126 is positioned in a cutout 130 formed the base plate portion 12 of the armature unit 11 as shown in FIG. 20. There are formed clearances between the base plate portion 12 of the armature unit 11 and the base portion 22 of the bobbin unit 21, and between the base plate portion 12 of the armature unit 11 and the first raised part 126*a*. This prevents direct contact between the base portion 22 and the base plate portion 12 and thereby prohibits the bobbin unit 21 (base portion 22) from adversely affecting vibrations of the armature 14.

When the drive unit 10 is assembled into the bottom housing section 5, the second raised part 126*b* of the projection 126 is inserted into the through hole 108 formed in the bottom housing section 5 as illustrated in FIG. 20. The drive unit 10 is positioned in relation to the bottom housing section 5 as the second raised part 126*b* (projection 126) is inserted into the through hole 108 in this fashion.

A side wall of the bottom housing section 5 comes in contact with the first raised part 126*a* of the projection 126, and there is formed a specified clearance between the base plate portion 12 of the armature unit 11 and the side wall of the bottom housing section 5 as can be seen from FIG. 20. This arrangement prevents direct contact between the base plate portion 12 and the side wall of the bottom housing section 5 so that the bottom housing section 5 (housing 2) would not adversely affect the vibration of the armature 14.

Figure 21:
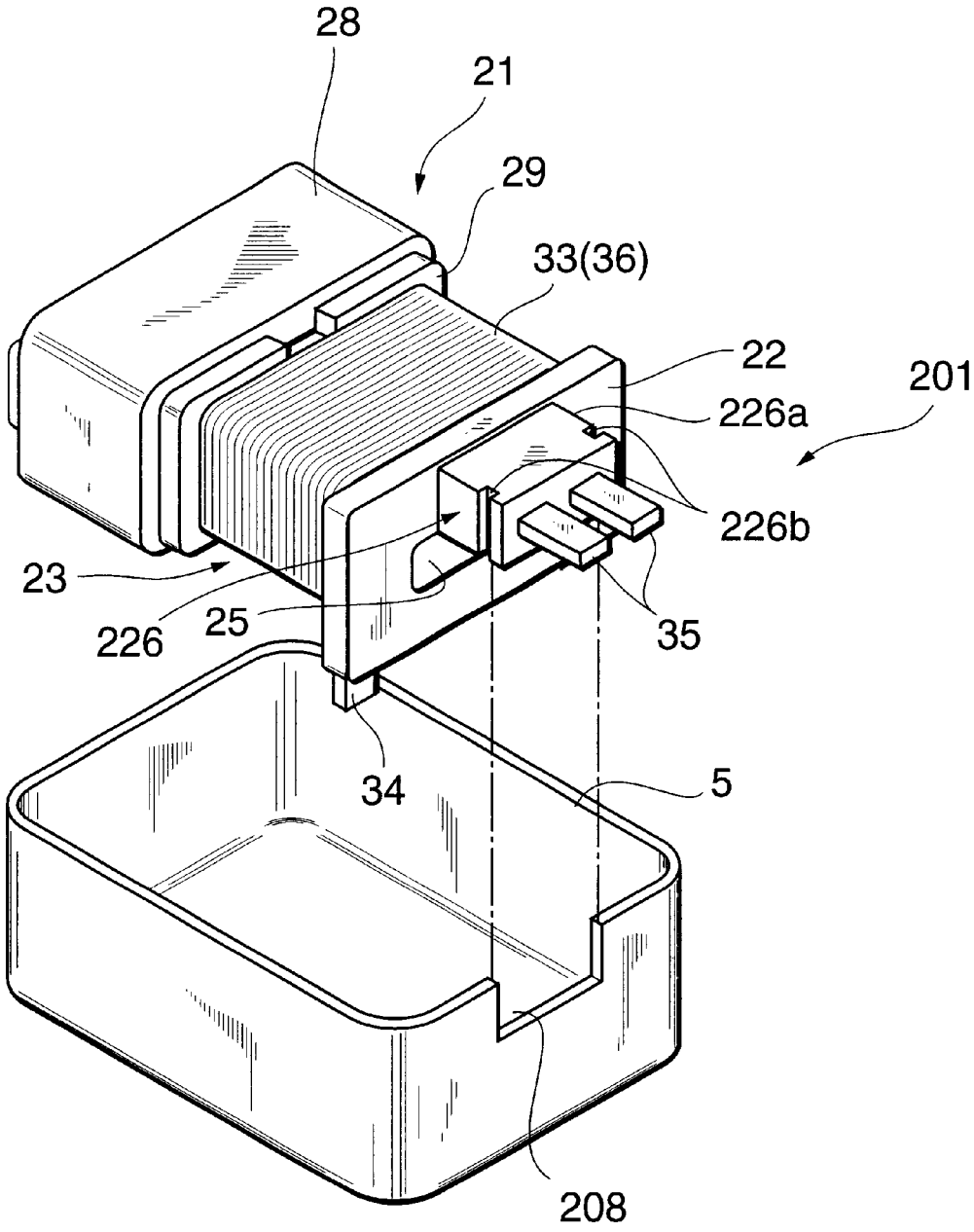
FIG. 21 is an exploded perspective view showing the construction of an electroacoustic transducer according to another variation of the embodiment of the invention.

Another variation of the foregoing embodiment is now described with reference to FIGS. 21 and 22. A electroacoustic transducer 201 shown in FIGS. 21 and 22 differs from the electroacoustic transducer 1 shown in FIGS. 1–18 in the construction of a cutout 208 and a projection 226, and in the orientation of an armature unit 11 (upside down with respect to an armature 14). FIG. 21 shows a bottom housing section 5 and a bobbin unit 21 only, omitting illustration of the other constituent parts.

Figure 22:
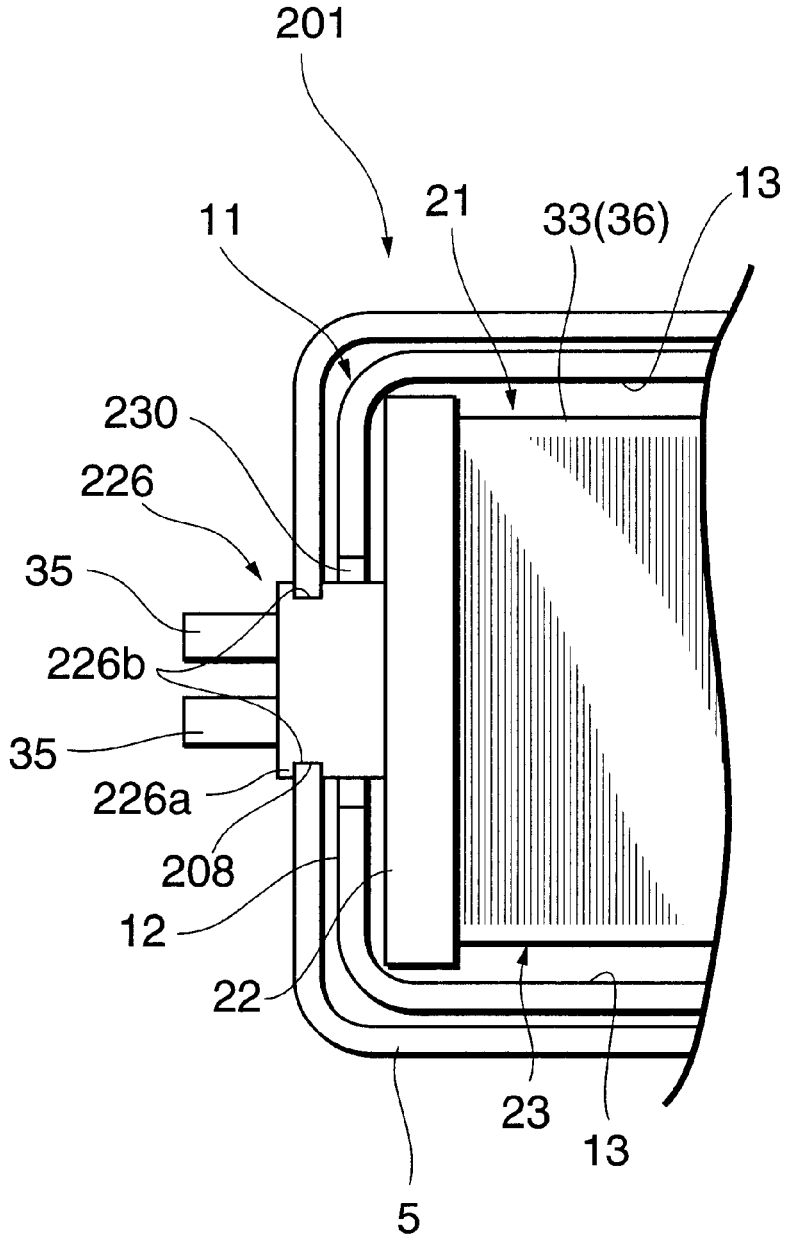
FIG. 22 is an enlarged fragmentary plan view showing the construction of the electroacoustic transducer of FIG. 21.

In the electroacoustic transducer 201 of this variation, the projection 226 is formed integrally with the base portion 22 on a surface of the base portion 22 opposed to the base plate portion 12 of the armature unit 11 as depicted in FIGS. 21 and 22. The projection 226 is provided on the opposite side of the coil side terminals 34 with respect to the hole 25. The signal input terminals 35 are provided such that they would extend in a direction generally at right angles to the surface of the base portion 22 (opposed to the base plate portion 12 of the armature unit 11) on which the projection 226 is formed. The signal input terminals 35 and the coil side terminals 34 are provided on opposite sides with the hole 25 located in between. The cutout (opening) 208 in the bottom housing section 5 is formed at its location corresponding to the signal input terminals 35 and the projection 226.

The projection 226 includes a projecting part 226*a* and a pair of grooves 226*b* formed in the projecting part 226*a*. The projecting part 226*a* of the projection 226 is positioned in a cutout 230 formed the base plate portion 12 of the armature unit 11 as shown in FIG. 22. There are formed clearances between the base plate portion 12 of the armature unit 11 and the base portion 22 of the bobbin unit 21, and between the base plate portion 12 of the armature unit 11 and the projecting part 226*a*. This prevents direct contact between the base portion 22 and the base plate portion 12 and thereby prohibits the bobbin unit 21 (base portion 22) from adversely affecting vibrations of the armature 14.

There are formed the grooves 226*b* in the projecting part 226*a* of the projection 226 as stated above. The drive unit 10 is positioned in relation to the bottom housing section 5 as edges of the cutout 208 in the bottom housing section 5 fit into the grooves 226*b* when the drive unit 10 is assembled into the bottom housing section 5, as illustrated in FIG. 22.

The location of the grooves 226*b* is determined such that a specified clearance is formed between the base plate portion 12 of the armature unit 11 and the side wall of the bottom housing section 5 when the edges of the cutout 208 in the bottom housing section 5 are fit into the grooves 226*b*. This location of the grooves 226*b* serves to prevent direct contact between the base plate portion 12 of the armature unit 11 and the side wall of the bottom housing section 5 and thereby prohibit the bottom housing section 5 (housing 2) from adversely affecting vibrations of the armature 14.

The electroacoustic transducers 101, 201 of the aforementioned variations have the same operational effects as the electroacoustic transducer 1 shown in FIGS. 1–18. These variations can also facilitate connection of the ends of the conductor 33 constituting the coil 36 to the signal input terminals 35 and prevent breakage of the conductor 33 between the coil 36 and the coil side terminals 34.

Furthermore, since the signal input terminals 35 and the coil side terminals 34 are provided on opposite sides with the hole 25 of the base portion located in between in the electroacoustic transducers 101, 201, the signal input terminals 35 and the coil side terminals 34 are separated from each other. Therefore, the distance from the tip of the arc-welding electrode 62 to each signal input terminal 35 becomes larger than the distance from the tip of the arc-welding electrode 62 to the corresponding coil side terminal 34 when the ends of the conductor 33 are connected to the coil side terminals 34 by arc welding. This helps prevent the occurrence of an arc between the tip of the arc-welding electrode 62 and the signal input terminals 35 and produce an arc between the tip of the arc-welding electrode 62 and the coil side terminals 34 in a reliable fashion. All these features of the invention ensure reliable connection of the ends of the conductor 33 to the coil side terminals 34.

Furthermore, the signal input terminals 35 project to the exterior of the bottom housing section 5 from its side wall through the through hole 108 or the cutout 208 when the bobbin unit 21 is located as a main part of the drive unit 10 in the bottom housing section 5 in the electroacoustic transducers 101, 201. With this arrangement, it becomes possible to provide a construction in which the signal input terminals 35 are exposed to the exterior of the bottom housing section 5 (housing 2) in a simple and inexpensive way.

While the signal input terminals 35 and the coil side terminals 34 are provided at both ends of the base portion 22 with the hole 25 located in between, or the signal input terminals 35 are provided on the opposite side of the coil side terminals 34 with the hole 25 located in between, in the above-described embodiment and the variations thereof, the invention is not limited to such constructions. In one alternative, the signal input terminals 35 and the coil side terminals 34 may be provided individually at different end portions of the base portion 22. In another alternative, the signal input terminals 35 and the coil side terminals 34 may be provided close to each other. As an example, the signal input terminals 35 may be provided between the coil side terminals 34 and the hole 25 in the base portion 22 of the bobbin unit 21.

If, however, the ends of the conductor 33 are to be connected to the coil side terminals 34 by arc welding, it is preferable to locate the signal input terminals 35 and the coil side terminals 34 in such a way that the distance from the tip of the arc-welding electrode 62 to each coil side terminal 34 becomes smaller than the distance from the tip of the arc-welding electrode 62 to the corresponding signal input terminal 35. If the signal input terminals 35 and the coil side terminals 34 are provided in this manner, it becomes possible to prevent the occurrence of an arc between the tip of the arc-welding electrode 62 and the signal input terminals 35 and produce an arc between the tip of the arc-welding electrode 62 and the coil side terminals 34 in a reliable fashion. This enables reliable connection of the ends of the conductor 33 to the coil side terminals 34.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. An electroacoustic transducer comprising:

a coil formed by winding a conductor;

a bobbin unit on which said coil is formed; and an armature unit having a base plate portion, at least one side plate portion extending from said base plate portion, and an armature extending from said base plate portion in the same direction as said side plate portion;

wherein said bobbin unit includes signal input terminals;

coil side terminals to which respective ends of said conductor are fixed, said coil side terminals being electrically connected to said signal input terminals;

a base portion in which a hole for inserting the armature of said armature unit is made;

a coil winding portion on which the conductor is wound;

a magnet positioning portion for positioning a magnet therein; and a magnet retainer for retaining said magnet positioned in said magnet positioning portion: and wherein said signal input terminals and said coil side terminals are provided individually at different end portions of said bobbin unit and at opposite positions with said hole in the base portion located in therein-between.

2. An electroacoustic transducer according to claim 1 wherein said armature unit is fixed to said bobbin unit by fixing said side plate portion to said magnet retainer, and there is formed a clearance between the base portion in said bobbin unit and the base plate portion of said armature unit when said armature unit is fixed to said bobbin unit.

3. An electroacoustic transducer according to claim 1 wherein said base portion, said coil winding portion and said magnet positioning portion are one-piece molded using a resin material.

4. An electroacoustic transducer according to claim 1 further comprising a housing in which said bobbin unit is accommodated, wherein an opening is formed in said housing at its location corresponding to said signal input terminals, and said signal input terminals project to the exterior of said housing through said opening when said bobbin unit is accommodate in said housing.

5. An electroacoustic transducer comprising:

a coil formed by winding a conductor;

a bobbin unit on which said coil is formed; and an armature unit having a base plate portion, at least one side plate portion extending from said base plate portion, and an armature extending from said base plate portion in the same direction as said side plate portion;

wherein said bobbin unit includes signal input terminals;

coil side terminals to which respective ends of said conductor are fixed, said coil side tern being electrically connected to said signal input terminals;

a base portion in which a hole for inserting the armature of said armature unit is made;

a coil winding portion on which said conductor is wound;

a magnet positioning portion for positioning a magnet therein; and a magnet retainer for retaining said magnet positioned in said magnet positioning portion; and wherein the ends of said conductor are fixed to said coil side terminals by arc welding;

wherein said signal input terminals and said coil side terminals are provided at positions where the distance from the tip of an electrode used for arc welding to said coil side terminals is smaller than the distance from the tip of said welding electrode to said signal input terminals;

wherein said bobbin unit includes a projection which is formed on a surface of said base portion opposed to said base plate portion of said armature unit;

wherein said projection is provided on the opposite side of said coil side terminals with respect to said hole; and wherein said signal input terminals are provided so as to extend in a direction generally at right angles to the surface of said base portion on which said projection is formed.

6. An electroacoustic transducer according to claim 5 further comprising a housing in which said bobbin unit is accommodated, wherein an opening is formed in said housing at its location corresponding to said signal input terminals, and said signal input terminals project to the exterior of said housing through said opening when said bobbin unit is accommodated in said housing.

* * * * *